US005906890A

United States Patent [19]

Taniguchi et al.

[11] Patent Number: 5,906,890

[45] Date of Patent: May 25, 1999

[54] POLYPROPYLENE FIBER, A METHOD FOR MANUFACTURE THEREOF, AND A NON-WOVEN FABRIC MADE OF THE SAME

[75] Inventors: Masahiko Taniguchi, Chiba; Hidemi Ito; Yoshimi Tsujiyama, both of Shiga, all of Japan

[73] Assignee: Chisso Corporation, Osaka, Japan

[21] Appl. No.: 08/894,191

[22] PCT Filed: Nov. 21, 1996

[86] PCT No.: PCT/JP96/03431

§ 371 Date: Aug. 14, 1997

§ 102(e) Date: Aug. 14, 1997

[87] PCT Pub. No.: WO97/21856

PCT Pub. Date: Jun. 19, 1997

[30] Foreign Application Priority Data

Dec. 14, 1995 [JP] Japan ..... 7-347774

[51] Int. Cl.[6] ..... D02G 3/00; D01D 5/14

[52] U.S. Cl. ..... 428/364; 428/361; 442/361; 264/181

[58] Field of Search ..... 428/375, 364; 442/361, 398; 264/181

[56] References Cited

U.S. PATENT DOCUMENTS

| | | | |
|---|---|---|---|
| 3,624,194 | 11/1971 | Pirot | 260/897 A |
| 4,814,032 | 3/1989 | Taniugchi et al. | 156/167 |
| 5,585,172 | 12/1996 | Barsotti | 428/290 |
| 5,750,256 | 5/1998 | Ito et al. | 428/375 |

FOREIGN PATENT DOCUMENTS

| | | |
|---|---|---|
| 2112456 | 4/1990 | Japan . |
| 8049166 | 2/1996 | Japan . |

*Primary Examiner*—Newton Edwards
*Attorney, Agent, or Firm*—McDermott, Will & Emery

[57] ABSTRACT

There is disclosed a polypropylene fiber which is suitable for hot rolling and which is used for producing a non-woven fabric having high tenacity and good feel by heat rolling within a wide range of processing temperatures.

A polypropylene fiber contains boiling n-heptane extract in the amount of 1.5 to 5 percent by weight after extraction with boiling n-hexane, and the extract has a melting point peak of 140° C. or higher.

7 Claims, No Drawings

POLYPROPYLENE FIBER, A METHOD FOR MANUFACTURE THEREOF, AND A NON-WOVEN FABRIC MADE OF THE SAME

DESCRIPTION

1. Technical Field

The present invention relates to a polypropylene fiber, and more specifically, to a polypropylene fiber which can be processed easily and efficiently by use of heat rollers and is used as a raw material for a heat-bonded non-woven polypropylene fabric, as well as to a method for the manufacture thereof and a non-woven fabric made of such a polypropylene fiber.

2. Background Art

Polypropylene fibers have been used in the production of non-woven fabrics wherein the fibers are thermally bonded to each other by use of heat rollers, and such non-woven fabrics have in turn been used as the surface materials of hygienic products such as disposable diapers or sanitary napkins. Although for years there has been demand for non-woven fabrics having high tenacity and soft feel for use as the surface material of hygienic products, still higher levels of tenacity and softness are demanded in connection with recent decreases in basis weight (weight per unit area). In order for heat rolling to yield a high-tenacity non-woven fabric, there must be complete fusion and bonding between polypropylene fibers. For this reason, the non-woven fabric must be produced under a high-temperature condition so that the fibers are sufficiently softened upon bonding. However, if a non-woven fabric is produced at a high temperature, the polypropylene fibers present in places other than bonding points are affected by heat, thereby resulting in degradation of feel (softness). This phenomenon is more significant for non-woven fabrics of lower basis weight. If a non-woven fabric is produced at a low roller temperature in order to prevent the degradation of feel, the tenacity of the resulting non-woven fabric becomes insufficient due to poor bonding. Therefore, a small difference in processing temperature lowers the tenacity and makes the feel stiffer, thereby reducing the allowable range of heat-processing conditions for producing desired non-woven fabrics having high tenacity and soft feel. Therefore, there has been demand for the development of soft and strong polypropylene fibers having a wide range of allowable processing temperatures suitable for heat rolling.

As a polypropylene fiber suitable for heat rolling, there is proposed in Japanese Patent Application Laid-open No. 62-156310 a polypropylene fiber comprising an ethylene-propylene random copolymer containing a predetermined amount of ethylene and having a softening point of 132° C. or below. However, the non-woven fabric produced from this fiber has a stiff feel, and there is a very narrow range of allowable processing temperature for producing non-woven fabrics having tenacity and feel suited for practical use. A polypropylene fiber containing a specific compound is proposed in Japanese Patent Application Laid-open No. 2-264012, but both feel and tenacity are insufficient. Furthermore, polypropylene fibers whose surfaces have been degraded by oxidation are proposed in Japanese Patent Applications Laid-open Nos. 4-228666 and 7-11508, but the non-woven fabrics produced from these fibers have a stiff feel. Although a number of efforts have been made to provide non-woven polypropylene fabrics having excellent tenacity and feel through the use of heat rolling, none of them have successfully provided both satisfactory properties of non-woven fabrics and a wide range of allowable processing temperatures. Thus, satisfactory polypropylene fibers have not yet been developed.

It is an object of the present invention to provide a polypropylene fiber which is suitable for easily producing non-woven fabrics having high tenacity and good feel, as well as for heat rolling with a wide range of allowable processing temperatures.

DISCLOSURE OF INVENTION

The inventors of the present invention conducted repeated examinations for solving the above problems, and found that the above object was achieved by a polypropylene fiber whose boiling n-heptane extract has a melting point peak of 140° C. or higher and is present in the amount of 1.5 percent by weight or more. The present invention has the following constitution.

According to a first aspect of the present invention, there is provided a polypropylene fiber which contains boiling n-heptane extract in the amount of 1.5 to 5 percent by weight after extraction with boiling n-hexane, said extract having a melting point peak of 140° C. or higher.

According to a second aspect of the present invention, there is provided a polypropylene fiber according to the first aspect, wherein the polypropylene is a crystalline copolymer of olefin-based monomers consisting mainly of propylene.

According to a third aspect of the present invention, there is provided a polypropylene fiber according to the first aspect, wherein the elongation of said fiber is 200 to 350 percent.

According to a fourth aspect of the present invention, there is provided a polypropylene fiber according to the first aspect, to which mineral oil or dibasic acid diester is applied in an amount between 0.03 and 0.5 percent relative to the weight of the fiber.

According to a fifth aspect of the present invention, there is provided a method for producing a polypropylene fiber comprising the steps of extruding polypropylene having a melt flow rate of 5 to 30 (g/10 minutes, 230° C.) at an extrusion temperature of 270 to 320° C.; drawing the yarn under the conditions that draft ratio (the ratio of the take-up velocity to the discharging linear speed) is 400 to 1,200, take-up velocity is 1,200 to 2,500 m/minute, and the temperature distribution of the fiber between the nozzle outlet and a point 0.5 m below the nozzle is controlled such that temperature decreases in the downward direction at a rate of 1.8 to 3.5° C./cm; and then stretching the resulting yarn to three times or less its original length at a temperature between 20 and 100° C.

According to a sixth aspect of the present invention, there is provided a non-woven fabric produced from a polypropylene fiber which contains boiling n-heptane extract in the amount of 1.5 to 5 percent by weight after extraction with boiling n-hexane, said extract having a melting point of 140° C. or higher.

According to a seventh aspect of the present invention, there is provided a non-woven fabric according to the sixth aspect, wherein the range of allowable processing temperatures for producing a non-woven fabric having a tenacity of 1.8 kg or more is 4° C. or more, said non-woven fabric having a flexibility of 30 mm or less.

The present invention will be described in detail below. The boiling n-heptane extract from the polypropylene fiber of the present invention must be present in the amount of at least 1.5 percent by weight. If the content of boiling n-heptane extract is less than 1.5 percent, the resulting non-woven fabric has low tenacity, and the range of processing temperatures for producing the non-woven fabric becomes narrow. The upper limit for the amount of the boiling n-heptane extract is 5.0 percent by weight, and amounts equal to or less than this value are preferred in view of better card passage.

The boiling n-heptane extract of a polypropylene fiber in the present invention is obtained by the following method. A polypropylene fiber which has been extracted with boiling n-hexane for 5 hours as pre-treatment is extracted with boiling n-heptane for 5 hours. The resulting extract is dried in a vacuum oven at 60° C. to remove n-heptane.

The resulting boiling n-heptane extract must have a melting point peak of 140° C. or higher. If more than one melting point peak is present, at least one melting point peak must be 140° C. or higher. If the melting point peak is less than 140° C., then the resulting non-woven fabric has a low tenacity, and wide range of allowable processing temperatures cannot be achieved. For the purpose of the present invention, the melting point peak refers to the peak of the melting point as measured by a differential scanning calorimeter (DSC).

Since the polypropylene fiber of the present invention contains boiling n-heptane extract in the amount of 1.5 percent by weight or more, and the extract has a melting point peak of 140° C. or higher, a non-woven fabric with high tenacity and good feel can be obtained, and a wide range of allowable processing temperatures can be achieved. This effect is significant when the elongation of the fiber is 200 to 350 percent, and is particularly significant when elongation is 200 to 300 percent.

For the purpose of the present invention, the range of allowable processing temperatures refers to the range of heat roller temperatures that provide non-woven fabrics with a target tenacity of 1.8 kg or higher, when the flexibility of the non-woven fabric, which refers to the degree of feel, is 30 mm or less.

Therefore, when the polypropylene fiber of the present invention is used, there can be produced a non-woven fabric with stable quality satisfying both tenacity and feel, and the temperature of heat rollers can be controlled easily because of the wide range of allowable processing temperatures. Thus, the processing speed of the non-woven fabric can be increased resulting in a high level of productivity. The range of processing temperatures is preferably 3° C. or more; more preferably 4° C. or more.

In the present invention, the boiling n-heptane extract of polypropylene fibers having a melting point of 140° C. or higher is considered to be a component greatly involved in the bonding of fibers. It has not been known whether the component extracted by boiling n-heptane having a melting point peak of 140° C. or higher is actually formed during the manufacturing process, or is merely concentrated in the surface layer of the fiber at this time. However, this component itself is believed to fuse the fibers together or function as an agent that lowers melting point, and is also believed to enhance the tenacity of the non-woven fabric over that made of conventional polypropylene fibers.

Although the polypropylene suitable for the material of the polypropylene fiber of the present invention may be a crystalline homopolymer of propylene, there may also be used a copolymer of olefin monomers consisting mainly of propylene. Preferred copolymers include crystalline binary random copolymers consisting of 85 percent or more propylene and 15 percent or less ethylene, or crystalline random terpolymers comprising 50 percent or more propylene and 50 percent or less butene-1.

The polypropylene fiber of the present invention may be produced by, for example, the following method. Polypropylene of an MFR between 5 and 30 (g/10 minutes, 230° C.) is extruded at an extrusion temperature between 270° C. and 320° C., a take-up velocity between 1,200 and 2,500 m/minute, and a draft ratio (the ratio of the take-up velocity to the discharging linear speed) of 400 to 1,200. The cooling condition during spinning is controlled so that the temperature distribution of the fiber between the nozzle outlet and a point 0.5 m below the nozzle decreases in the downward direction at a rate of 1.8 to 3.5° C./cm. The resulting yarn is then stretched three times or less its original length at a temperature between 20 and 100° C. Furthermore, it is preferable to use oil containing components that easily permeate into polypropylene, such as mineral oil or dibasic acid diester; e.g., DOP (di-2-ethylhexyl phthalate) and di-2-ethylhexyl adipate, since use of such oil enhances the effect of the present invention. The amount of the oil is preferably 0.03 to 0.5 percent by weight.

The polypropylene fiber of the present invention may be a short fiber or a long fiber.

Various additives normally used in polypropylene fibers, such as light stabilizers, lubricants, anti-static agents, and pigments may be added to the polypropylene fiber of the present invention, in amounts that do not inhibit the object of the present invention.

EXAMPLES

The present invention will be described by referring to preferred embodiments. However, the present invention is not limited to these embodiments. The properties cited in examples and comparative examples were measured by the following methods.

Melt flow rate (MFR) was measured in accordance with Condition (L) of ASTM D 1238.

Melting point was measured using a 7-Series Thermal Analysis System from PERKIN-ELMER. About 2 mg of the sample was heated from 30° C. to 230° C. at a heating rate of 10° C./minute, maintained at 230° C. for 10 minutes, cooled to −60° C. at a cooling rate of −20° C./minute, and maintained at −60° C. for 10 minutes. The sample was again heated to 230° C. at a heating rate of 10° C./minute, and the melting point peak then indicated was designated as the melting point.

The elongation of the fiber was measured in accordance with JIS L1015, 7. 7. 1.

The tenacity of the non-woven fabric was measured by the following method. From a non-woven fabric of a basis weight of 20 g/m$^2$ produced while the flexibility in the direction perpendicular to the machine running direction was adjusted to 30 mm, there were cut two kinds of specimens one having dimensions of 15 cm long in the machine running direction and 5 cm wide in the transverse direction, and the other having 5 cm wide in the machine running direction and 15 cm long in the traverse direction. The tenacity at break of the specimens was measured using a tensile tester under conditions of a grip distance of 10 cm and a strain rate of 100 mm/minute, and was defined by the following equation.

$$\text{Tenacity of non-woven fabric} = (\text{tenacity at break in machine running direction} \times \text{tenacity at break in transverse direction})^{1/2}$$

Flexibility was measured in accordance with JIS L1018 6.21A. A non-woven fabric (specimen) having a length of 15 cm and a width of 5 cm cut from a non-woven fabric of a basis weight of 20 g/m$^2$ was placed on a horizontal table (a cantilever-type tester) that heat a flat surface slanted 45 degrees with respect; to an edge, with a graduated scale provided on the surface. The specimen was manually guided to allow it to slide toward the slanted surface, and the length of the specimen when the end of the specimen contacted the slanted surface was measured in millimeters. This value was designated as the index of flexibility. Smaller values indicate better flexibility of the non-woven fabric.

The range of allowable processing temperatures is the range of heat roller temperatures that provide a non-woven fabric having a flexibility of 30 mm or less, and a tenacity of 1.8 kg or higher. For example, if a non-woven fabric meeting this requirement is obtained in a range between 130° C. and 134° C., the range of allowable processing temperatures is 4° C.

EXAMPLE 1

Polypropylene having an MFR of 15 (g/10 minutes, 230° C.) was melted and spun at an extrusion temperature of 300° C. and a take-up velocity of 1,500 m/minute in order to obtain a raw yarn. The draft ratio at this time was 960. The average cooling rate from the nozzle outlet to the point 0.5 m below the nozzle was 2.1° C./cm. This raw yarn was stretched to 1.3 times its original length at a stretching temperature of 60° C., mechanically crimped in a stuffing box, and then cut into short staples having a length of 38 mm. The oil then used consisted of the following components, and was applied in the amount of 0.5 percent by weight relative to the weight of the fiber PEG 400 dilaurate 75 percent by weight C8 phosphate potassium salt 25 percent by weight The amount of boiling n-heptane extract of the resulting fiber and the melting point peak of boiling n-heptane extract are shown in Table 1. The fiber was then carded using a roller carding machine operating at a speed of 20 m/minute to form a web of a basis weight of 20 g/m$^2$. The web was processed into a non-woven fabric using an emboss roll having an bonding area ratio of 24 percent and operating at the same speed. The temperatures of the emboss roll were changed in increments of 0.5° C. At each temperature, specimens were prepared from resulting non-woven fabrics, and tenacity and flexibility were measured to determine the tenacity of non-woven fabrics when the flexibility was 30 mm, as well as the range of allowable processing temperatures. These values are also shown in Table 1.

EXAMPLE 2

A non-woven fabric was prepared in the same way as in Example 1, except that polypropylene having an MFR of 10 (g/10 minutes, 230° C.) was used, the take-up velocity was 1,800 m/minute, and the average cooling rate from the nozzle outlet to the point 0.5 m below the nozzle was 2.5° C./cm. The characteristics are shown in Table 1.

COMPARATIVE EXAMPLE 1

A non-woven fabric was prepared in the same way as in Example 1, except that the stretching temperature was 130° C. The characteristics are shown in Table 1.

COMPARATIVE EXAMPLE 2

A non-woven fabric was prepared in the same way as in Example 2, except that the extrusion temperature was 350° C. and the draft ratio was 3,000. The characteristics are shown in Table 1.

EXAMPLE 3

A non-woven fabric was prepared in the same way as in Example 1, except that the take-up velocity was 2,000 m/minute, the draft ratio was 700, and the stretching was to 1.8 times original length. The characteristics are shown in Table 1.

EXAMPLE 4

A non-woven fabric was prepared in the same way as in Example 2, except that the average cooling rate from the nozzle outlet to the point 0.5 m below the nozzle was 2.0° C./cm, and the stretching temperature was 80° C. The characteristics are shown in Table 1.

EXAMPLE 5

A non-woven fabric was prepared in the same way as in Example 1, except that there was used a random copolymer consisting of 99.8 percent propylene and 0.2 percent ethylene, and having an MFR of 25 (g/10 minutes, 230° C.). The characteristics are shown in Table 1.

In each of the above examples and comparative examples, the thickness of the fibers after stretching was adjusted to 2 d/f.

EXAMPLE 6

A yarn was spun and a non-woven fabric was prepared in the same way as in Example 1, except that 50 percent of the PEG 400 dilaurate in the oil used in Example 1 was replaced by dioctyl adipate, a dibasic acid diester, to form the following composition, which was applied to the fiber in the amount of 0.5 percent by weight relative to the weight of the fiber.

PEG 400 dilaurate 37.5 percent by weight dioctyl adipate 37.5 percent by weight

C8 phosphate potassium salt 25.0 percent by weight

TABLE 1

| | Example 1 | Example 2 | Comparative Example 1 | Comparative Example 2 | Example 3 | Example 4 | Example 5 | Example 6 |
|---|---|---|---|---|---|---|---|---|
| Amount of boiling n-heptane extract (% by weight) | 2.14 | 1.97 | 0.64 | 2.17 | 1.89 | 1.98 | 2.45 | 2.14 |
| Melting point peaks of boiling n-heptane extract (° C.) | 137.9<br>148.1 | 132.6<br>155.3 | 136.5<br>142.3 | 116.2<br>130.9 | 133.5<br>154.2 | 143.3<br>152.8 | 135.8<br>145.2 | 137.9<br>148.1 |
| Fiber elongation (%) | 250 | 230 | 245 | 205 | 215 | 240 | 245 | 250 |
| Tenacity when flexibility is 30 mm (kg) | 2.8 | 2.7 | 1.2 | 2.1 | 2.5 | 3.0 | 2.8 | 2.8 |

TABLE 1-continued

| | Example 1 | Example 2 | Comparative Example 1 | Comparative Example 2 | Example 3 | Example 4 | Example 5 | Example 6 |
|---|---|---|---|---|---|---|---|---|
| Range of allowable processing temperature (° C.) | 5.0 | 4.5 | 0 | 1.0 | 4.0 | 6.0 | 4.5 | 7.0 |

The polypropylene fiber of the present invention can be used for producing a non-woven fabric of the present invention having high tenacity and good feel by heat rolling within a wide range of processing temperatures. Such a polypropylene fiber may be easily produced by the method of the present invention.

We claim:

1. A polypropylene fiber which contains boiling n-heptane extract in the amount of 1.5 to 5 percent by weight after extraction with boiling n-hexane, said extract having a melting point peak of 140° C. or higher.

2. A polypropylene fiber according to claim 1, wherein the polypropylene is a crystalline copolymer of olefin-based monomers consisting mainly of propylene.

3. A polypropylene fiber according to claim 1, wherein the elongation of said fiber is 200 to 350 percent.

4. A polypropylene fiber according to claim 1, to which mineral oil or dibasic acid diester is applied in an amount between 0.03 and 0.5 percent relative to the weight of the fiber.

5. A method for producing a polypropylene fiber which contains boiling n-heptane extract in the amount of 1.5 to 5% by weight after extraction with boiling n-hexane, said extract having a melting point peak of 140° C. or higher, the method comprising the steps of extruding polypropylene having a melt flow rate of 5 to 30 (g/10 minutes, 230° C.) at an extrusion temperature of 270 to 320° C.; drawing the fiber under the conditions that draft ratio (the ratio of the take-up velocity to the discharging linear speed) is 400 to 1,200, take-up velocity is 1,200 to 2,500 m/minute, and the temperature distribution of the fiber between the nozzle outlet and a point 0.5 m below the nozzle is controlled such that temperature decreases in the downward direction at a rate of 1.8 to 3.5° C./cm; and then stretching the resulting fiber to three times or less its original length at a temperature between 20 and 100° C.

6. A non-woven fabric produced from a polypropylene fiber which contains boiling n-heptane extract in the amount of 1.5 to 5 percent by weight after extraction with boiling n-hexane, said extract having a melting point of 140° C. or higher.

7. A non-woven fabric according to claim 6, wherein the range of allowable processing temperatures for producing a non-woven fabric having a tenacity of 1.8 kg or more is 4° C. or more, said non-woven fabric having a flexibility of 30 mm or less.

* * * * *